US007641943B2

(12) United States Patent
Asuke

(10) Patent No.: US 7,641,943 B2
(45) Date of Patent: Jan. 5, 2010

(54) COATING METHOD, LIQUID SUPPLYING HEAD AND LIQUID SUPPLYING APPARATUS

(75) Inventor: Shintaro Asuke, Suwa (JP)

(73) Assignee: Seiko Epson Corporation (JP)

( * ) Notice: Subject to any disclaimer, the term of this patent is extended or adjusted under 35 U.S.C. 154(b) by 749 days.

(21) Appl. No.: 11/312,979

(22) Filed: Dec. 20, 2005

(65) Prior Publication Data

US 2006/0141167 A1 Jun. 29, 2006

(30) Foreign Application Priority Data

Dec. 24, 2004 (JP) ..... 2004-374495

(51) Int. Cl.
*B05D 1/32* (2006.01)

(52) U.S. Cl. ..... 427/466; 427/476; 427/533; 427/542; 427/553; 427/588

(58) Field of Classification Search ..... 427/466, 427/476, 533, 542, 553, 588
See application file for complete search history.

(56) References Cited

U.S. PATENT DOCUMENTS 6,019,907 A * 2/2000 Kawamura ..... 216/27
6,561,624 B1 * 5/2003 Kikugawa et al. ..... 347/45
6,821,716 B2 * 11/2004 Karasawa et al. ..... 430/320
2001/0028378 A1 * 10/2001 Lee et al. ..... 347/68

FOREIGN PATENT DOCUMENTS

| | | |
|---|---|---|
| GB | 2283208 | 5/1995 |
| JP | 6-171081 | 6/1994 |
| JP | 07-125220 | 5/1995 |
| JP | 3093634 | 7/2000 |
| JP | 2003-63014 | 3/2003 |
| TW | 568837 | 12/2002 |

* cited by examiner

*Primary Examiner*—Binh X Tran
(74) *Attorney, Agent, or Firm*—Harness, Dickey & Pierce, P.L.C.

(57) ABSTRACT

A coating method is provided for forming a liquid-repellent coat on a predetermined partial region of an inner surface of each through-hole of a nozzle plate. The nozzle plate is provided in an ink-jet head of an ink-jet printer. The coating method comprises the steps of: forming a coat preform on a region including the partial region of the inner surface; supplying a mask material having ultraviolet ray absorbability into the coated through-hole; irradiating ultraviolet rays onto the base material to partially decompose and remove the coat preform on the inner surface; and removing the mask material in the through-hole to obtain the nozzle plate partially coated with the liquid-repellent coat. The coat preform removal is conducted through the use of attenuation of the ultraviolet rays by means of the mask material or through the combined use of the ultraviolet ray attenuation and the presence/absence of the mask material.

14 Claims, 6 Drawing Sheets

COATING METHOD, LIQUID SUPPLYING HEAD AND LIQUID SUPPLYING APPARATUS

CROSS-REFERENCE

The entire disclosure of Japanese Patent Application No. 2004-374495 filed on Dec. 24, 2004 is expressly incorporated by reference herein.

BACKGROUND OF THE INVENTION

1. Field of the Invention

The present invention relates to a coating method, a liquid supplying head and a liquid supplying apparatus.

2. Description of the Prior Art

An ink-jet head (liquid supplying head) is provided with a nozzle plate which has a plurality of minute nozzle holes mutually spaced apart with a narrow spacing left therebetween. The ink-jet head is designed to perform printing operations by ejecting ink droplets from apertures (ink-ejecting apertures) formed at one side of the nozzle holes and landing the ink droplets on a printing paper. In such an ink-jet head, once ink is adhered to a surface of the nozzle plate at the side where the ink-ejecting apertures lie, the flight trajectory of the ink droplets ejected next time becomes flexed under the influence of surface tension or viscosity of the adhered ink. This makes it difficult for the ink droplets to be landed on target spots. Taking this into account, an attempt has been made to form a liquid-repellent coat which consists of a fluorine-based resin or the like. In this attempt, the liquid-repellent coat is formed on an ink ejecting aperture-side surface of the nozzle plate, and further on a predetermined region (which is adjacent to the ink ejecting aperture) of an inner surface of each nozzle hole. This type of liquid-repellent coat is formed in the following manner, as taught in Japanese Laid-open Patent Publication No. 1995-125220 for example.

A nozzle plate is prepared first, and a photosensitive resin film which is curable by irradiation of light is laminated on the opposite surface of the nozzle plate from ink-ejecting apertures. Subsequently, the laminated resin film is heated while applying pressure on the film. Thus, the photosensitive resin film is heat-and-pressure bonded to the rear surface of the nozzle plate, and at the same time those parts of the photosensitive resin film facing to the nozzle holes are caused to enter the individual nozzle holes.

Then, ultraviolet rays are irradiated onto the photosensitive resin film to cure the latter. Subsequently, the nozzle plate is dipped and agitated in an electrolysis solution which contains nickel ions and a fluorine resin dispersed by electric charges. In this way, a eutectoid plating layer is formed on the part of the nozzle plate not covered with the photosensitive resin film, i.e., on the ink ejecting aperture-side surface of the nozzle plate and on the inner surface parts of the nozzle holes adjacent to the ink-ejecting apertures. Finally, the photosensitive resin film is dissolved and removed by use of a solvent, after which the nozzle plate is heated at a temperature no greater than the melting point of the fluorine resin contained in the eutectoid plating layer.

Through the process described above, a liquid-repellent coat is formed on the ink ejecting aperture-side surface of the nozzle plate and on the predetermined region (which is adjacent to the ink-ejecting apertures) of the inner surface of each nozzle hole. However, this method involves following problems.

The method described above employs the photosensitive resin film. Therefore, even for the regions of the nozzle plate that do not require formation of the liquid-repellent coat, it is required to perform the steps of: bonding a photosensitive resin film to a nozzle plate by heat and pressure; curing the photosensitive resin film; and dissolving and removing the photosensitive resin film.

Not only do these steps involve complexity but also they require installations for carrying out each of the steps. In addition, the photosensitive resin film is inherently expensive, which in turn increases production costs.

SUMMARY OF THE INVENTION

In view of the problems in the prior art described in the above, it is an object of the present invention to provide a coating method that can form a coat on a predetermined partial region of an inner surface of each through-hole of a base material, with the use of simplified steps and installations in a cost-effective manner.

Another object of the present invention is to provide a liquid supplying head that has a liquid-repellent coat formed by the coating method.

A further object of the present invention is to provide a liquid supplying apparatus that is equipped with the liquid supplying head.

In order to achieve the above object, the present invention is directed to a coating method for forming a coat on a base material having at least one through-hole, the through-hole having an inner surface between one end and the other end thereof the coat being formed on a predetermined partial region of the inner surface of the through-hole, the partial region of the inner surface running a predetermined length from the one end of the through-hole toward the other end, the method comprising the steps of:

forming a coat preform to be processed into the coat, on a region including the partial region of the inner surface of the through-hole;

supplying a mask material having ultraviolet ray absorbability into the through-hole having the coat preform;

irradiating ultraviolet rays onto the base material from a side at which the other end of the through-hole lies, to remove the coat preform irradiated by the ultraviolet rays while leaving intact the coat preform on the partial region, wherein the coat preform left through the irradiation forms the coat, and wherein the coat preform removal is conducted through the use of attenuation of the ultraviolet rays by means of the mask material or through the combined use of the ultraviolet ray attenuation and the presence/absence of the mask material; and removing the mask material in the through-hole after the irradiation.

This method makes it possible to form the coat on the predetermined partial region of the inner surface of the through-hole of a base material, with simplified steps and installations in a cost-effective manner.

In this invention, it is preferred that the coat preform is formed from a liquid which contains a constituent of the coat. The method (liquid-phase coating method) using such a liquid makes sure that the coat preform is formed in an easy and reliable manner.

Further, in this invention, it is also preferred that the ultraviolet rays are irradiated under an atmospheric pressure. This eliminates the need for a vacuum pump, which helps reduce the costs involved in producing the coat.

Furthermore, in this invention, it is also preferred that the ultraviolet rays are irradiated in a nitrogen gas atmosphere. This gets rid of the possibility that the ultraviolet rays are absorbed to water vapor present in the atmosphere and attenuated eventually. As a result, it becomes possible to decompose and remove the coat preform uniformly (with no irregularity) over predetermined portions of the base material.

Moreover, in this invention, it is also preferred that the ultraviolet rays are irradiated by irradiating means for emitting the ultraviolet rays, and that the irradiation is made under a condition that the base material is spaced apart 1-50 mm from the irradiating means. This helps enhance the decomposition efficiency (processing efficiency) of the coat preform.

Moreover, in this invention, it is also preferred that the wavelength of the ultraviolet rays is no greater than 250 nm. Using the ultraviolet rays of such wavelength makes it possible to completely decompose and remove the coat preform on the predetermined portions of the base material.

Moreover, in this invention, it is also preferred that the illuminance of the ultraviolet rays is in the range of 1-50 $W/cm^2$. This assures that coat preform can be decomposed and removed more effectively.

Moreover, in this invention, it is also preferred that the mask material comprises a substance that shows no substantial change in quality under condition of applying the ultraviolet rays. This makes sure that predetermined useless portions of the coat preform can be removed in an easy and reliable manner.

Moreover, in this invention, it is also preferred that the mask material comprises a substance that can be removed by volatilization. This makes sure that the mask material can be removed with a simplified installation and at a reduced cost.

Moreover, in this invention, it is also preferred that the mask material comprises a substance that can be removed by cleansing with water-based wash fluid. This enables the mask material to be removed with a simplified installation and at a reduced cost.

Moreover, in this invention, it is also preferred that the mask material includes water as a main component. Such a mask material is capable of relatively easily absorbing and attenuating the ultraviolet rays that have entered therein. Further, the mask material is easy to remove by volatilization. In addition, it can be readily purchased at a low cost.

Moreover, in this invention, it is also preferred that the mask material includes water-soluble polymer as a main component. Use of this mask material is desirable in that it is capable of relatively easily absorbing and attenuating the ultraviolet rays that have entered therein, and can be removed from nozzle holes with little difficulty.

Moreover, in this invention, it is also preferred that the through-hole is provided at the one end thereof with an aperture whose average area is in the range of 75-750,000 $\mu m^2$. The coating method of the present invention can be advantageously employed in forming the coat on the inner surface of the through-hole that has such an ultra fine size. This allows the coat to be easily and reliably formed on the predetermined partial region of the inner surface of the through-hole.

Moreover, in this invention, it is also preferred that, at the step of forming the coat preform, the coat preform is formed on an external surface of the base material as well as on the inner surface of the through-hole, and that coat is so formed as to extend continuously on the partial region of the inner surface of the through-hole, and further on the external surface of the base material lying at the same side as the one end of the through-hole.

Another aspect of the present invention is directed to a liquid supplying head, comprising:

a main body provided with at least one flow passageway for allowing a liquid to pass therethrough, the flow passageway having an inner surface and an opening at one side which constitutes an outlet aperture from which the liquid is discharged, the inner surface of the flow passageway having a predetermined partial region which is adjacent to the outlet aperture; and a liquid-repellent coat formed by the coating method of this invention in a manner that the liquid-repellent coat extends continuously on the partial region of the inner surface of the flow passageway and further on an external surface of the main body lying at the same side as the outlet aperture of the main body.

This liquid supplying head has an ability to reliably and uniformly supply the liquid on target spots.

In the liquid supplying head of the present invention, it is preferred to further comprises a liquid droplet ejecting means for ejecting the liquid from the outlet aperture in the form of droplets.

Further, the other aspect of the present invention is directed to a liquid supplying apparatus equipped with the liquid supplying head of this invention. This liquid supplying apparatus is capable of reliably and uniformly supplying the liquid to target spots.

These and other objects, structures and advantages of the present invention will be apparent more clearly from the following description of the invention based on the examples.

DETAILED DESCRIPTION OF THE PREFERRED EMBODIMENTS

A coating method, a liquid supplying head and a liquid supplying apparatus according to the present invention will be described hereinbelow with reference to the accompanying drawings which show a preferred embodiment.

First of all, description is made with regard to an embodiment of an ink-jet head which incorporates the liquid supplying head of this invention. Although an ink-jet head employing an electrostatic driving system is described in the present embodiment by way of example, it should be noted that the invention is not limited to the ink-jet head disclosed herein, but may be applied to other types of ink-jet heads, e.g., a piezoelectric driving type ink-jet head.

Figure 1:
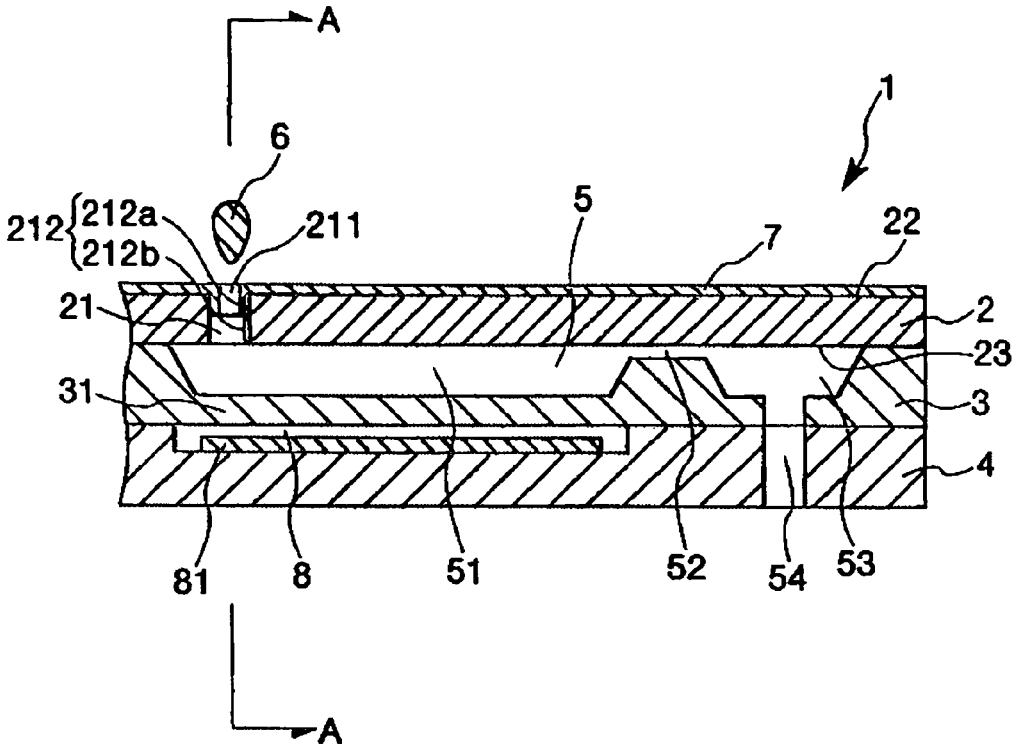
FIG. 1 is a vertical section view showing an embodiment of an ink-jet head which incorporates a liquid supplying head according to the present invention.

FIG. 1 is a vertical section view showing an embodiment of the ink-jet head which incorporates the liquid supplying head of this invention. In this drawing, the ink-jet head is shown upside down as compared to its normal use condition. For the sake of convenience in description, the upper side in FIG. 1 is referred to as "top", "upper" or its equivalents, and the lower side is referred to as "bottom", "lower" or its equivalents.

The ink-jet head 1 shown in FIG. 1 is of an electrostatic driving type. This ink-jet head 1 is provided with a main body having a nozzle plate 2, a cavity plate 3 and an electrode plate 4. In the main body, the cavity plate 3 is sandwiched between the nozzle plate 2 and the electrode plate 4.

A plurality of steps are formed on the cavity plate 3, so that a gap 5 is defined between the nozzle plate 2 and the cavity plate 3. The gap 5 includes a plurality of mutually separated ink-ejecting chambers 51; orifices 52 formed at the rear sides of the respective ink-ejecting chambers 51; and a common reservoir 53 for feeding ink to each of the ink-ejecting chambers 51. An ink inlet port 54 is formed at the bottom of the reservoir 53. Those parts of the cavity plate 3 facing the ink-ejecting chambers 51 are thin-walled, so that each of them can serve as a vibration diaphragm 31 for changing the pressure within the corresponding ink-ejecting chamber 51.

A plurality of nozzle holes (through-holes) 21 are formed through the nozzle plate 2 so as to respectively communicate with the ink-ejecting chambers 51. Each of the nozzle holes 21 acts as a flow passageway through which the ink (liquid) can be discharged from the ink-ejecting chamber 51. The opening formed at the upper side (one side) of each of the nozzle holes 21 constitutes an ink-ejecting aperture (outlet aperture) 211 through which the ink is ejected in the form of ink droplets (liquid droplets) 6.

A liquid-repellent coat 7 is formed on an external surface 22 of the nozzle plate 2 which lies at the same side as the ink-ejecting aperture 211. In addition, the liquid-repellent coat 7 is also formed on a partial region 212*a* (that is, a predetermined region adjacent to the ink-ejecting aperture 211) of an inner surface 212 of each nozzle hole 21. The liquid-repellent coat 7 mentioned above is formed in such a manner that it can extend continuously over the external surface 22 and over each partial region 212*a*. In this connection, it should be noted that in this embodiment the term of "partial region" means a predetermined region of the inner surface 212 which runs a predetermined length (depth) from the top end (one end) of the nozzle hole 21 toward the bottom end (the other end).

The liquid-repellent coat 7 is a coat that exhibits greater repellency (for example, a contact angle of 90 degrees) against the ink than the surface of the nozzle plate 2. Therefore, in a case that water-soluble ink is to be used, a coat having greater water repellency than the surface of the nozzle plate 2 is formed. On the contrary, in a case that hydrophobic (lipophilic) ink is to be used, a coat having greater hydrophilicity than the surface of the nozzle plate 2 is formed. The liquid-repellent coat 7 formed in this manner prohibits the ink from adhering to the periphery of each of the ink-ejecting apertures 211, thus assuring that the ink droplets 6 can be sprayed in a direction substantially coinciding with an axis of each of the nozzle holes 21.

In case of forming a water-repellent coat as one type of the liquid-repellent coat 7, various kinds of water-repellent resin materials may be used. Examples of such water-repellent resin materials include various kinds of coupling agents with water-repellent functional groups such as a fluoroalkyl group, an alkyl group, a vinyl group, an epoxy group, a styryl group and a metacryloxy group; fluorine-based resins such as polytetrafluoroethylene (PTFE), tetrafluoroethylene-perfluoroalkylvinylether copolymer (PFA), ethylene-tertafluoroethylene copolymer (ETFE), perfluoroethylene-propene copolymer (FEP), ethylene-chlorotrifluoroethylene copolymer (ECTFE) and perfluoroalkylether; and a silicon resin. One example of commercially available products for the water-repellent coat is "OPTOOL DSX" manufactured by Daikin Industries, Ltd., a Japanese corporation.

Further, in case of forming a hydrophilic coat as one type of the liquid-repellent coat 7, various kinds of hydrophilic resin materials may be used. Examples of the hydrophilic resin materials include various kinds of coupling agents having functional groups such as a hydroxyl group, a carboxyl group and an amino group; and polyvinyl alcohol.

In this connection, it should be noted that these resin materials are representative examples of the substances for use in forming either the water-repellent coat or the hydrophilic coat. Further, it should also be noted that a coat formed from the above-listed materials may have both of the properties, water repellency and hydrophilicity.

Average thickness of the liquid-repellent coat 7 should preferably be, but is not particularly limited to, in the range of about 0.01-20 μm and more preferably be in the range of about 0.01-0.3 μm.

The coating method according to the present invention is employed in forming the liquid-repellent coat 7 mentioned above. Description will be given later regarding the method of forming the liquid-repellent coat 7 (that is, an embodiment of the coating method of the present invention).

Average area of the ink-ejecting aperture 211 (the opening at the one end of each of the nozzle holes 21) should preferably be, but is not particularly limited to, in the range of about 75-750,000 $\mu m^2$, and more preferably be in the range of about 300-8,000 $\mu m^2$. It is preferred that the coating method of this invention is employed in order to form the liquid-repellent coat 7 on the inner surface 212 of each of the nozzle holes 21 having such a small diameter as described above. This ensures that the liquid-repellent coat 7 can be easily and reliably formed on the partial region 212*a* of the inner surface 212 of each of the nozzle holes 21.

In the ink-jet head 1 shown in FIG. 1, the electrode plate 4 is bonded to the cavity plate 3 at the side opposite to the nozzle plate 2, so that the cavity plate 3 is sandwiched between the nozzle plate 2 and the electrode plate 4. The electrode plate 4 has recesses at its portions facing the vibration diaphragms 31 so that vibration chambers 8 can be defined between the electrode plate 4 and the vibration diaphragms 31. At the bottom of each vibration chamber 8, an electrode 81 is provided on the electrode plate 4 so as to face the corresponding vibration diaphragm 31. In this configuration, the vibration diaphragms 31, the vibration chambers 8 and the electrodes 81 cooperate with one another to provide an electrostatic actuator (liquid droplet ejecting means).

In this type of ink-jet head 1, when pulse voltages are applied to the electrodes 81 by means of a signal generating circuit, the surface of the electrodes 81 are positively charged, while the corresponding lower surfaces of the vibration diaphragms 31 are charged with negative potential. In response, the vibration diaphragms 31 are bent downwardly by the attracting force of the static electricity generated in this process. Then, when the pulse voltages are cut off under this state, the electric charges gathered in the electrodes 81 and the vibration diaphragms 31 are rapidly discharged, and hence each of the vibration diaphragms 31 is restored substantially to its original shape by its resilient force. At this moment, the pressure within the ink-ejecting chambers 51 soars up drastically to thereby cause the ink droplets to be ejected toward a sheet (printing paper P) through each of the nozzle holes 21. Then, when the vibration diaphragms 31 are caused to be bent downwardly once again, the ink in the reservoir 53 is supplemented to the ink-ejecting chambers 51 through the respective orifices 52.

The ink-jet head 1 described above can be produced through the following process for example.

Figure 2:
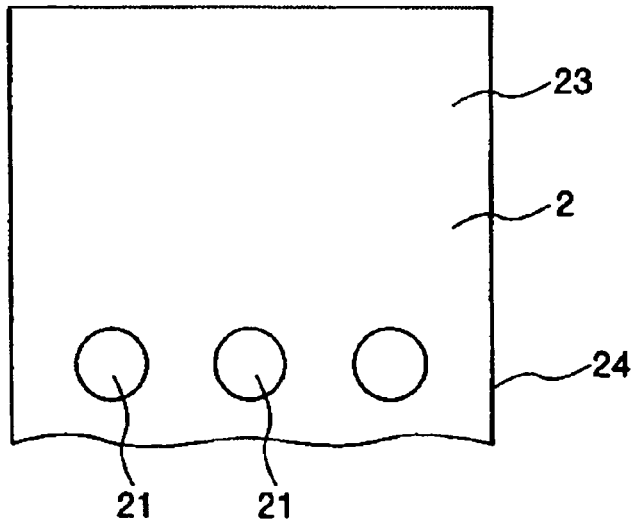
FIG. 2 is a view which illustrates a method of producing the ink-jet head shown in FIG. 1.
Figure 3:
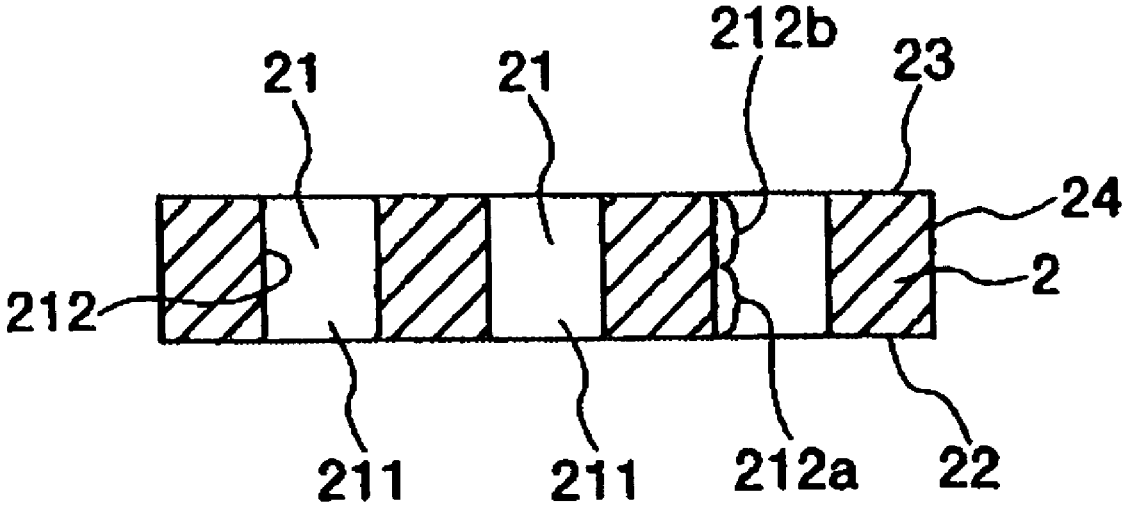
FIG. 3 is a view which illustrates a method of producing the ink-jet head shown in FIG. 1.

FIGS. 2-3 are views respectively illustrating a method of producing the ink-jet head shown in FIG. 1. Among these views, FIG. 2 is a top view of the nozzle plate incorporated in the ink-jet head. FIGS. 3-6 are vertical section views of the nozzle plate taken along line A-A in FIG. 1. In FIG. 5, an example of ultraviolet irradiators is shown schematically. It should be noted that the nozzle plate is shown upside down in FIGS. 3-6 as compared to the nozzle plate illustrated in FIG. 1. For the sake of convenience in description, the upper side in FIGS. 3-6 is referred to as "top", "upper" or its equivalents, and the lower side is referred to as "bottom", "lower" or its equivalents.

The ink-jet head producing method illustrated in FIGS. 3-6 comprises:

(i) Step of forming coat preform;

(ii) Step of supplying mask material into nozzle holes;

(iii) Step of removing useless portions of the coat preform;

(iv) Step of removing the mask material; and (v) Step of bonding plates.

The coating method according to the present invention is applied to the steps (i)-(iv) among the steps noted just above. Hereinafter, description for the above-listed steps will be given in sequence.

(i) Step of Forming Coat Preform (First Step)

Initially, as shown in FIGS. 2 and 3, a nozzle plate (base material) 2 is prepared, that has a plurality of nozzle holes 21 mutually spaced apart with a tiny spacing left therebetween. The nozzle plate 2 is made of, e.g., metal, ceramics, silicon, glass, plastics or the like. Among these materials, it is particularly desirable to use metals such as titanium, chromium, iron, cobalt, nickel, copper, zinc, tin and gold; alloys such as a nickel-phosphor alloy, a tin-copper-phosphor alloy (phosphor bronze), a copper-zinc alloy and stainless steel; polycarbonate; polysulphone; an ABS resin (acrylonitrile-butadiene-styrene copolymer); polyethylene terephthalate; polyacetal; or the like.

Figure 4A:
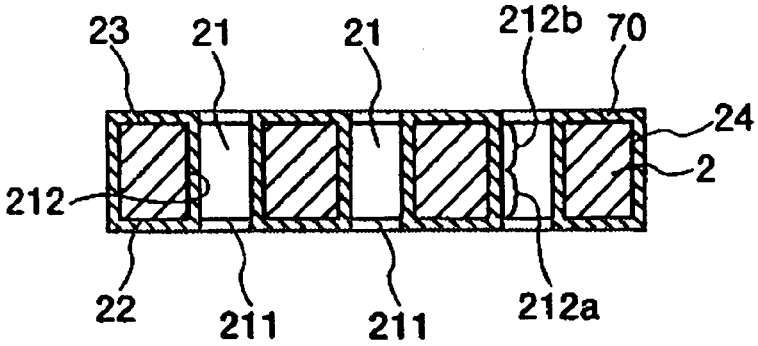
FIG. 4 is a view which illustrates a method of producing the ink-jet head shown in FIG. 1.
Figure 4B:
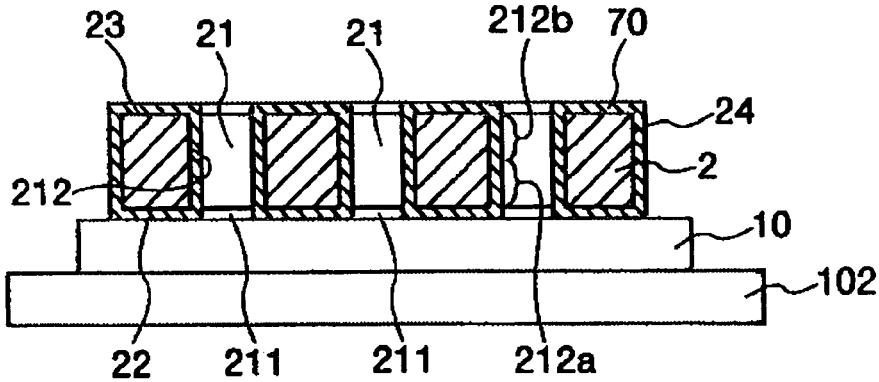

Subsequently, as shown in FIG. 4(*a*), a coat preform 70 for use in obtaining a liquid-repellent coat 7 is formed on the almost entire surface inside each nozzle hole 21 (that is, on a region comprising the partial region 212*a* of the inner surface 212), as well as on the external surface of the nozzle plate 2. The liquid-repellent coat 7 can be obtained by removing predetermined useless portions of the coat preform 70 at the step (iii) set forth below.

The coat preform 70 is formed by virtue of, e.g., a method of bringing a liquid containing the afore-mentioned materials for the liquid-repellent coat 7 into contact with the nozzle plate 2; Chemical Vapor Deposition (CVD) methods such as a plasma CVD a thermal CVD and a laser CVD; and dry plating methods such as a vacuum deposition, a sputtering and an ion plating. Among these methods, it is desirable to form the coat preform 70 by the method of bringing the liquid material into contact with the nozzle plate 2 (liquid-phase coating method). Using the liquid-phase coating method makes sure that the coat preform 70 can be formed in an easy and reliable manner. In the liquid-phase coating method, the nozzle plate 2 can be brought into contact with the liquid by, e.g., dipping the nozzle plate 2 into the liquid (dipping method); applying the liquid on the nozzle plate 2 (application method); or showering the nozzle plate 2 with the liquid.

(ii) Step of Supplying Mask Material into Nozzle Holes (Second Step)

In this step, a mask material 9 with ultraviolet ray absorbability is filled or supplied into the nozzle holes 21 of the nozzle plate 2 on which the coat preform 70 has been formed.

First, as illustrated in FIG. 4(*b*), a sheet member 10 is detachably attached onto the surface 22 of the nozzle plate 2 coated with the coat preform 70, so that the ink-ejecting aperture 211 of each of the nozzle holes 21 (that is, one end of the nozzle holes 21) is closed up as shown in this figure. Then, the nozzle plate 2 is placed on a support stage 102 of an ultraviolet irradiator (ultraviolet ray irradiating device) 100 in such a manner that the sheet member 10 attached to the nozzle plate 2 lies at the bottom side. (Configuration of the ultraviolet irradiator 100 will be described later.) In this connection, instead of using the sheet member 10, the nozzle plate 2 may be directly placed and fixed onto the support stage 102 in such a manner that the surface 22 of the coated nozzle plate 2 lies thereon, so that the ink-ejecting aperture 211 of each of the nozzle holes 21 is closed up. In this case, it is preferable for the support stage 102 to have a mechanism for fixing the nozzle plate 2 onto the support stage 102, such as an electrostatic fixing mechanism, a magnetic fixing mechanism or the like.

In case of using, for example, the high viscosity of the mask material 9, it becomes difficult to fill the mask material 9 into the nozzle holes 21 in a depth leading to the ink-ejecting aperture 211 (that is, in a depth leading to the one end of each of the nozzle holes 21). In such a case, filling the mask material 9 into the nozzle holes 21 may be conducted in advance of attaching the sheet material 10 to the nozzle plate 2 or placing the nozzle plate 2 onto the support stage 102.

Figure 4C:
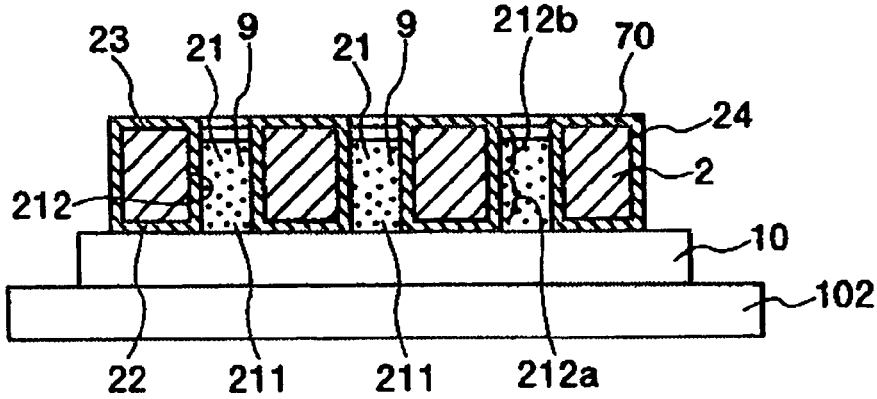
Figure 5:
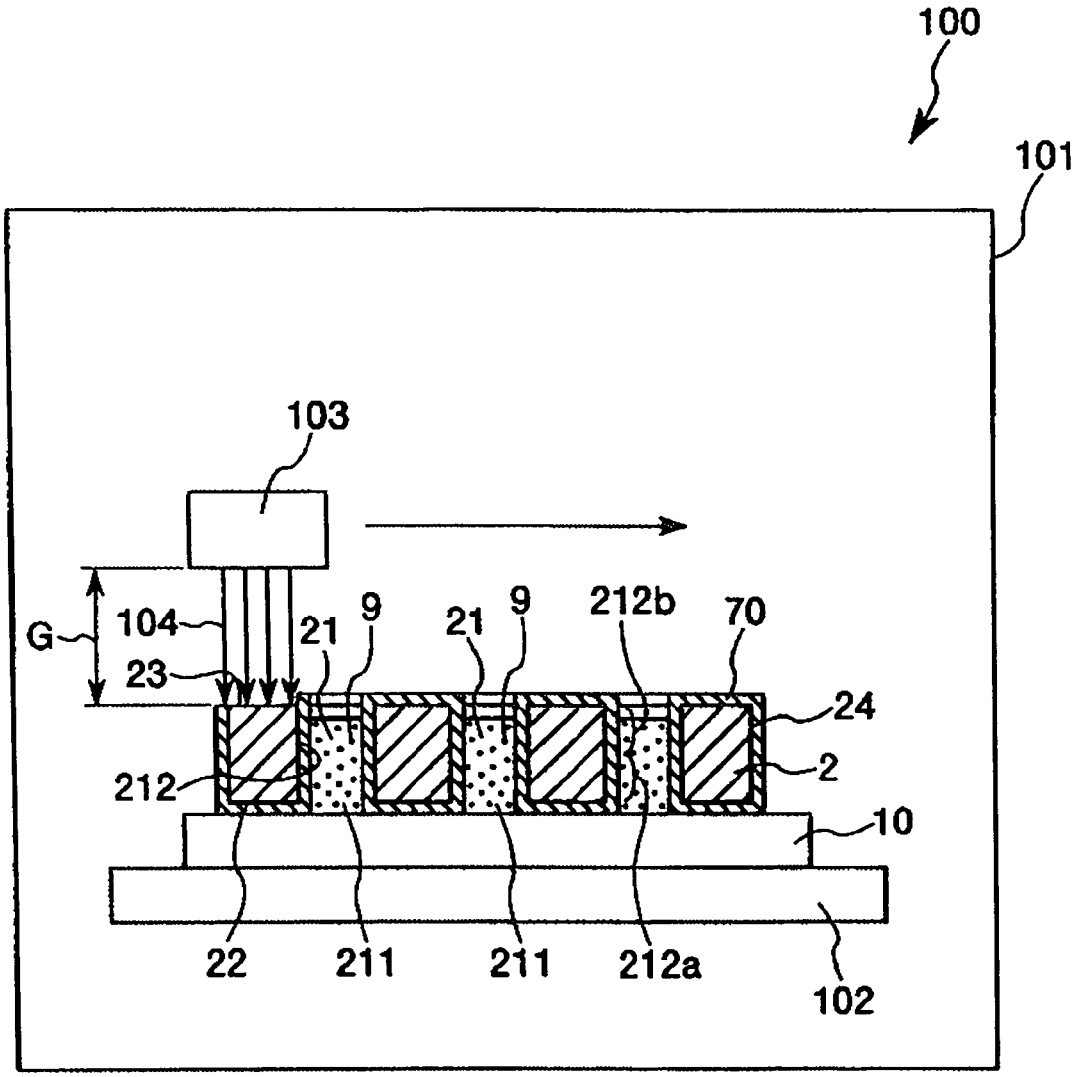
FIG. 5 is a view which illustrates a method of producing the ink-jet head shown in FIG. 1.

Then, as shown in FIG. 4(*c*), the mask material 9 is supplied into each of the nozzle holes 21 from the top end (the other end) thereof. In this embodiment, the mask material 9 is filled into each nozzle hole 21 such that the mask material 9 covers the coat preform 70 formed on the region including the predetermined partial region 212*a* of the inner surface 212. Namely, in the example shown in FIG. 4(C), the mask material 9 is filled into each nozzle hole 21 so as to cover the coat preform 70 formed on the region a little wider than the partial region 212*a* of the inner surface 212. In this connection, depending on the kind of the mask material 9 to be used, it would be possible to supply the mask material 9 into the nozzle holes 21 so as to substantially fill them with the mask material 9.

The mask material 9 should preferably be made of a substance that shows no change in quality when irradiated by the ultraviolet rays at the step (iii) described later, although other kinds of substances exhibiting a little bit of quality change may be used as the mask material 9. Using such a substance as the mask material 9 ensures that the predetermined useless portions of the coat preform 70 can be easily and completely removed.

In addition, the mask material 9 should preferably be made of a substance that can be removed by volatilization or by cleansing with a water-based wash fluid (awash fluid mainly composed of water), although it may be made of an organic solvent or the like. Using such a substance as the mask material 9 assures that removal of the mask material 9 at the step (iv) described later can be carried out with the use of simple installations and in a cost-effective manner.

Examples of the mask material 9 removable by volatilization include liquid-phase substances comprising inorganic solvents such as water, a carbon tetrachloride and ethylene carbonate; various kinds of organic solvents, e.g., ketone-based solvents such as methylethyl ketone (MEK), acetone, diethyl ketone, methylisobutyl ketone (MIBK), methylisopropyl ketone (MIPK) and cyclohexanone, alcohol-based solvents such as methanol, ethanol, isopropanol, ethylene glycol, diethylene glycol (DEG) and glycerin, ether-based solvents such as diethyl ether, diisopropyl ether, 1,2-dimethoxy ethane (DME), 1,4-dioxane, tetrahydrofuran (THF), tetrahydropyran (THP), anisole, diethylene glycol dimethylether (diglyme) and diethylene glycol ethylether (carbitol), cellosolve-based solvents such as methyl cellosolve, ethyl cellosolve and phenyl cellosolve, aliphatic carbonate-based solvents such as hexane, pentane, heptane and cyclohexane, aromatic carbonate-based solvents such as toluene, xylene and benzene, aromatic heterocyclic compound-based solvents such as pyridine, pyrazine, furan, pyrrole, thiopene and methyl pyrrolidone, amide-based solvents such as N,N-dimethylformamide (DMF) and N,N-dimethylacetamide (DMA), halogen compound-based solvents such as dichloromethane, chloroform, and 1,2-dichloroethane, ester-based solvents such as ethyl acetate, methyl acetate and ethyl formate, sulfur compound-based solvents such as dimethylsulfoxide (DMSO) and sulforane, nitrile-based solvents such as acetonitrile, propionitrile and acrylonitrile, organic acid-based solvents such as foric acid, acetic acid, trichloroacetic acid and trifluoroacetic acid; and mixed solvents containing these inorganic and organic solvents.

The volatile mask material 9 is desirably selected depending on the kinds of constituents of the coat preform 70 (liquid-repellent coat 7). In other words, the mask material 9 is selected from those substances that have no tendency to swell or dissolve the coat preform 70. As the mask material 9 removable by volatilization, it is preferred to use a substance mainly composed of water such as distilled water, ion-exchanged water, pure water, ultra-pure water and RO water. Since such a substance is easily available at a low cost and easy to remove by volatilization, use of the substance is preferred. In addition, use of the substance is desirable from the view point that the substance is capable of relatively easily absorbing and attenuating the ultraviolet rays that have entered into the mask material 9.

As the mask material 9 removable by washing with a water-based wash fluid, it is preferred to use a solid substance mainly composed of water-soluble polymers, although either water-soluble low-molecular substances or water-soluble low-molecular substances may be used for that purpose. Use of this mask material is desirable in that it is capable of relatively easily absorbing and attenuating the ultraviolet rays that have entered into the mask material 9 and can be easily removed from the nozzle holes.

Examples of the water-soluble polymers include starch, collagen, cellulose, crystalline cellulose, methyl cellulose, hydroxypropyl cellulose, hydroxymethylpropyl cellulose, ethyl cellulose, hydroxyethyl cellulose, sodium polyacrylate, carboxymethyl cellulose or their salts; mucopolysaccharide such as polyvinyl alcohol, polyvinyl pyrrolidone, carboxyvinyl polymer, alkyl modified carboxyvinyl polymer, acrylate-alkyl methacrylate copolymer, chondroitin sulfate, hyaluronic acid, mucin, dermatan sulfate, heparin, keratan sulfate or their salts; alginic acid or its salt; gum acacia; agar; pullulan; carragheenan; locust bean gum; xantan gum; chitin; hydrolyzed chitin; and gelatin. These substances may be used independently or in combination.

The task of filling or supplying the mask material 9 into the nozzle holes 21 is performed by, for example, a spin coating method and an ink-jet method. Use of these methods assures that the mask material 9 can be filled or supplied into the nozzle holes 21 in a reliable manner. In this connection, in case of using a liquid-phase substance as the mask material 9, it can be used as it is. However, in case of using a solid-phase substance as the mask material 9, it should preferably be used in the form of a solution or dispersion liquid containing the mask material 9.

(iii) Step of Removing Useless Portions of Coat Preform (Third Step)

In this step, ultraviolet rays are irradiated onto the nozzle plate 2 from the opposite side to the ink-ejecting aperture 211 of the nozzle holes 21 (that is, from the other end side of the nozzle holes 21).

FIG. 5 shows one example of an ultraviolet irradiator for use in removing predetermined useless portions of the coat preform 70. As shown in FIG. 5, the ultraviolet irradiator 100 is provided with the support stage 102 on which the nozzle plate 2 is placed, and an irradiating head (ultraviolet ray irradiating means) 103 for irradiating ultraviolet rays 104 onto regions of fine size. Both of the support stage 102 and the irradiating head 103 are accommodated within a chamber 101.

The irradiating head 103 is kept spaced apart a predetermined spacing (designated by "G" in FIG. 5) from the nozzle plate 2 which is placed on the support stage 102. Further, the irradiating head 103 can be operated to move in a direction generally parallel to the top surface 23 of the nozzle plate 2. In order to remove the coat preform 70 formed on the top surface 23 of the nozzle plate 2 and on the regions 212*b* (that is, on the regions other than the partial regions 212*a* of the inner surfaces 212 of the nozzle holes 21), the irradiating head 103 is turned on and then is moved in a direction generally parallel to the top surface 23 of the nozzle plate 2.

Figure 6A:
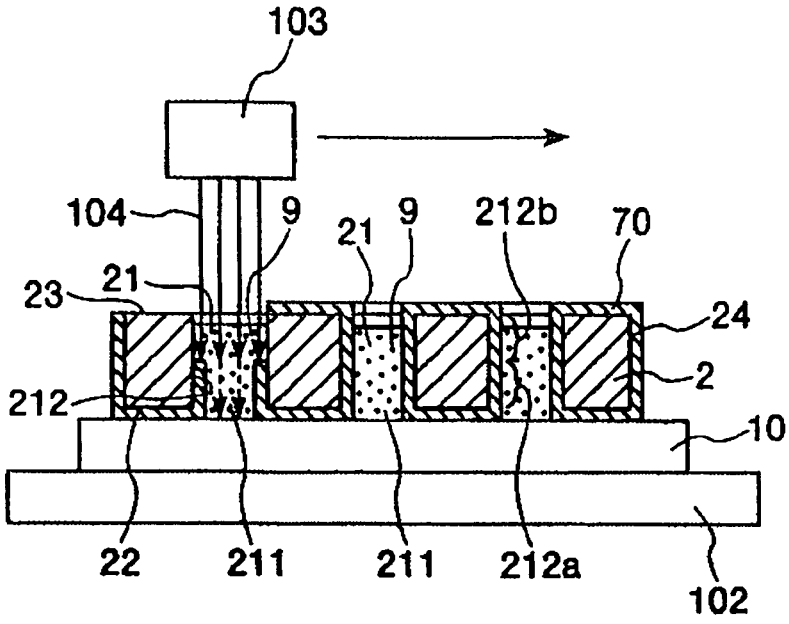
FIG. 6 is a view which illustrates a method of producing the ink-jet head shown in FIG. 1.
Figure 6B:
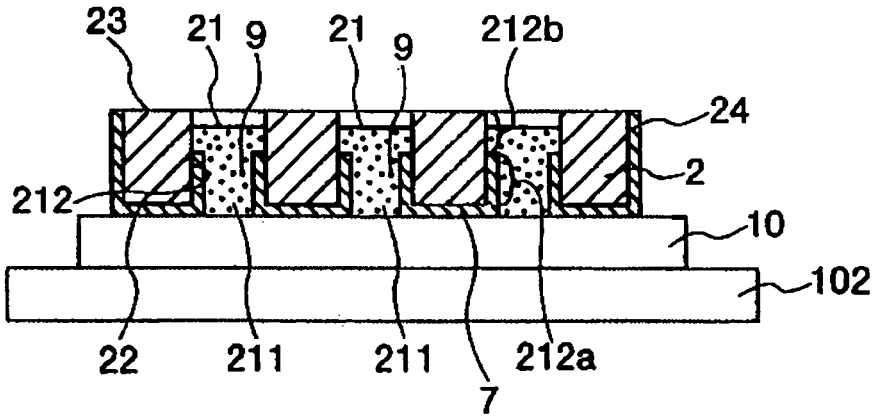
Figure 6C:
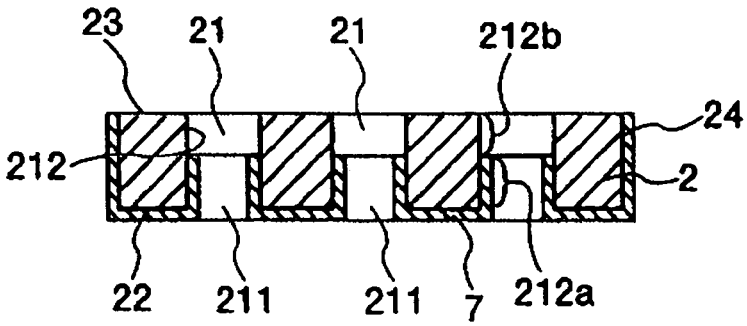

As shown in FIG. 5, when the ultraviolet rays 104 are irradiated onto the top surface 23 of the nozzle plate 2 by the irradiating head 103, the coat preform 70 formed on the surface 23 of the nozzle plate 2 is decomposed and removed. Further, when the ultraviolet rays 104 are irradiated into the nozzle holes 21 as shown in FIG. 6(*a*), the coat preform 70 not covered by the mask material 9 (i.e., the coat preform 70 formed on the regions free from the mask material 9) is directly exposed to the ultraviolet rays 104, whereby the uncovered coat preform 70 is decomposed and removed from the inner surface 212 of each of the nozzle holes 21. At this time, some ultraviolet rays 104 enter into and penetrate the upper side of the mask material 9, and therefore the coat preform 70 at this portion of the mask material 9 is also decomposed and removed by virtue of the entered ultraviolet rays 104. In the course of penetrating the mask material 9, the ultraviolet rays 104 are absorbed and attenuated little by little. Thus, the coat preform 70 existing at the bottom side of the mask material 9 is not decomposed. Therefore, by way of performing the irradiation of the ultraviolet rays 104 for a predetermined period of time, the coat preform 70 formed on the region 212*b* above the partial region 212*a* is removed, while leaving intact the coat preform 70 in the partial region 212*a*.

In this invention, the ultraviolet irradiation described above is performed with respect to the entire top surface 23 of the nozzle plate 2 and the respective nozzle holes 21. As a result, predetermined useless portions of the coat preform 70 are removed as shown in FIG. 6(*b*), while leaving intact the coat preform 70 formed on the surface 22 of the nozzle plate 2 lying at the same side as the ink-ejecting aperture 211; on the flank surfaces 24 of the nozzle plate 2; and on the partial region 212*a* of the inner surface 212 of each of the nozzle holes 21. Thus, the coat preform 70 left through the ultraviolet irradiation forms a liquid-repellent coat 7

Accordingly, on the inner surface 212 of each of the nozzle holes 21 in a longitudinal direction thereof, there are created a liquid-repellent zone that has the liquid-repellent coat 7 and that exhibits reduced wetting property to the ink. Further, on the inner surface 212, there are also created a lyophilic zone that has no liquid-repellent coat (due to removal of the coat preform 70) and that exhibits increased wetting property to the ink.

In this invention, it is possible to form the liquid-repellent coat 7 such that a demarcation line between the liquid-repellent zone and the lyophilic zone lies on a predetermined position. This is achieved by way of, at the step (iii), properly combining and adjusting such factors as the kind of the mask material 9, the wavelength of the ultraviolet rays 104, the illuminance of the ultraviolet rays 104, the irradiation time of the ultraviolet rays 104 (the moving speed of the irradiating head 103) and the like.

If needed, the coat preform 70 may be removed from the flank surfaces 24 of the nozzle plate 2.

The wavelength of the ultraviolet rays 104 used in the ultraviolet irradiation process should preferably be no greater than 250 nm, and more preferably be no greater than 200 nm. Use of the ultraviolet rays 104 in this wavelength range ensures that the coat preform 70 can be decomposed and removed in a reliable manner. In case of employing the product "OPTOOL DSX" manufactured by Daikin Industries, Ltd., a Japanese corporation, as a substance for the coat preform 70 (liquid-repellent coat 7), it is preferred to use the ultraviolet rays 104 whose wavelength is equal to 172 nm. In this case, the mask material 9 which contains water as a main component is preferably used.

The illuminance of the ultraviolet rays 104 should preferably be in the range of about 1-50 W/cm$^2$, and more preferably be in the range of about 5-25 W/cm$^2$. This makes sure that the coat preform 70 can be decomposed and removed in an efficient manner.

The moving speed of the irradiating head 103 should preferably be in the range of about 1-25 mm/sec, and more preferably be in the range of about 2-20 mm/sec.

The spacing (designated by "G" in FIG. 5) between the irradiating head 103 and the nozzle plate 2 should preferably be in the range of about 1-50 mm, and more preferably be in the range of 1-30 mm. This helps enhance the decomposition efficiency (processing efficiency) of the coat preform 70.

The pressure within the chamber 101 should preferably be the atmospheric pressure, although a vacuum pressure may be employed, if desired. In other words, it is preferred that the ultraviolet irradiation is carried out under the atmospheric pressure. This eliminates the need for a vacuum pump, which helps reduce the costs involved in producing the nozzle plate 2 and consequently the production costs of the ink-jet head 1.

Further, the chamber 101 should preferably be kept in an atmosphere, like a nitrogen gas atmosphere and an inert gas atmosphere, which contains no water vapor or contains an extremely small amount of water vapor, although one of the air atmosphere, the nitrogen gas atmosphere and the inert gas atmosphere may be employed, for instance. This gets rid of the possibility that the ultraviolet rays 104 are absorbed to water vapor which would otherwise exists in the atmosphere and attenuated eventually. As a result, it becomes possible to decompose and remove the coat preform 70 uniformly (with no irregularity) over the predetermined portions of the nozzle plate 2 exposed to the ultraviolet rays.

Among these atmospheres, the nitrogen gas atmosphere is particularly preferred, because the nitrogen gas is easy to acquire and less costly.

(iv) Step of Removing Mask Material (Fourth Step)

The nozzle plate 2 is taken out from the support stage 102, and the sheet member 10 is peeled off from the nozzle plate 2, after which the mask material 9 left in the nozzle holes 21 is removed as shown in FIG. 6(*c*).

The method of removing the mask material 9 is not subjected to particular limitations. For example, in case of using a liquid-phase substance as the mask material 9, the mask material 9 can be removed by volatilization at the room temperature or at an elevated temperature. Further, it can also be removed by cleansing with a wash fluid. In the event that a water-soluble polymer is used as the mask material 9, the mask material 9 can be removed by cleansing with a water-based wash fluid (wash fluid mainly composed of water) or other like methods.

In addition, it is desirable to properly select the method of removing the mask material 9 depending on the kind of the mask material 9. For example, in case of using the mask material 9 which is mainly composed of a resin material with reduced water solubility, it can be removed through the use of an organic solvent that has the ability to dissolve the resin material with no likelihood of dissolving or swelling the coat preform 70 (liquid-repellent coat 7).

Going through the steps (i)-(iv) mentioned above, the liquid-repellent coat 7 is formed on predetermined regions of the nozzle plate 2. Forming the liquid-repellent coat 7 in this manner eliminates the need to use expensive substances such as a photosensitive resin material (resist material), thus reducing the costs involved in producing the liquid-repellent coat 7 to a great extent. Another beneficial effect is that the liquid-repellent coat 7 can be uniformly formed within a plurality of nozzle holes 21 in a lump.

In the present embodiment, description has been made on an instance that the liquid-repellent coat 7 is formed on the partial region 212*a* of the inner surface 212 of each of the nozzle holes 21. The formation described above is achieved through the combined use of the attenuation of the ultraviolet rays 104 by means of the mask material 9 and the presence/absence of the mask material 9. However, this invention is not limited to the embodiment described above, and the liquid-repellent coat 7 may be formed by primarily taking advantage of the attenuation of the ultraviolet rays 104 by means of the mask material 9. This can be accomplished by, for example, adjusting the ultraviolet irradiator 100 and selecting the mask material in such a manner as to keep relatively high the transmissivity of the ultraviolet rays 104 through the mask material 9. In this case, the nozzle holes 21 may be substantially filled with the mask material 9.

(v) Step of Bonding Plates (Fifth Step)

A cavity plate 3 and an electrode plate 4 are produced in advance and put in a condition for use. Then, the top surface of the nozzle plate 2 (that is, the opposite surface from the ink-ejecting apertures 211) is bonded to the surface of the cavity plate 3 on which steps are formed. Further, the surface of the electrode plate 4 at which electrodes 81 lie is bonded to the surface of the cavity plate 3 on which vibration diaphragms 31 are disposed.

Figure 7:
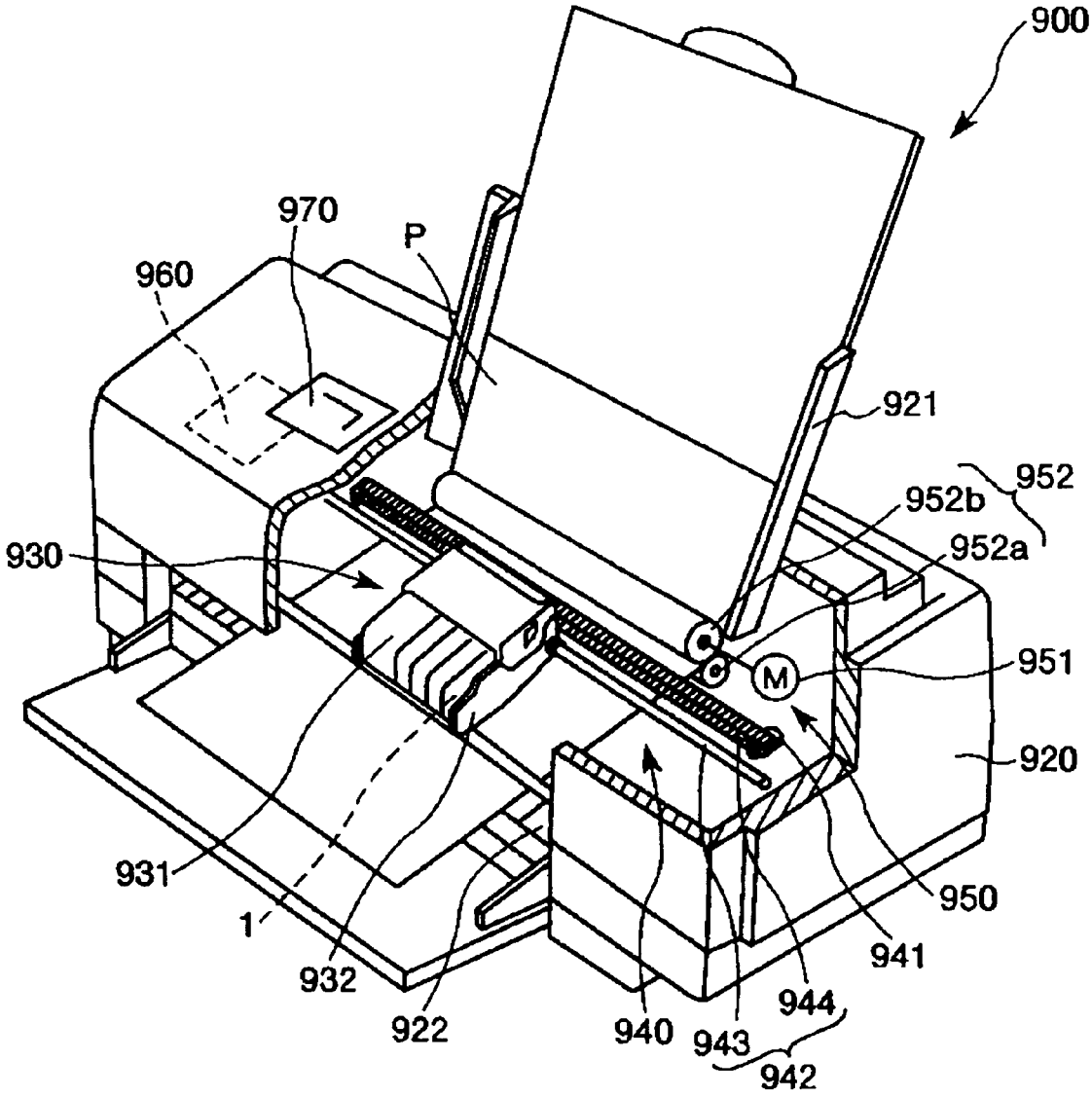
FIG. 7 is a schematic view showing an embodiment of an ink-jet printer which incorporates a liquid supplying apparatus according to the present invention.

Through the steps (i)-(v) described above, the ink-jet head 1 is manufactured. The ink-jet head 1 thus obtained is mounted to an ink-jet printer (a liquid supplying apparatus of this invention) shown in FIG. 7. FIG. 7 is a schematic view showing an embodiment of an ink-jet printer which incorporates the liquid supplying apparatus according to the present invention.

The ink-jet printer 900 illustrated in FIG. 7 is provided with a main body 920 that has a tray 921 for holding printing papers P at the top rear part; a discharge opening 922 for discharging the papers P therethrough at the bottom front part; and a manipulation panel 970 at the top surface.

The manipulation panel 970 includes, e.g., a liquid crystal display; an organic EL display; an LED lamp; a display part (not shown) for indicating error messages and other information; and an operation part (not shown) with a plurality of switches.

Provided within the main body 920 are a printing device (printing means) 940 having a reciprocating head unit 930; a sheet feeder (paper feeding means) 950 for feeding the papers P toward the printing device 940 in a sheet-by-sheet manner;

and a control unit (control means) 960 for controlling the printing device 940, the sheet feeder 950 and other devices.

In response to an instruction from the control unit 960, the sheet feeder 950 intermittently feeds the papers P sheet by sheet, so that each paper P passes through beneath the head unit 930. At this time, the head unit 930 is caused to reciprocate in a direction generally orthogonal to the paper feeding direction, whereby printing is performed in the process of feeding each paper P. In other words, the reciprocating movement of the head unit 930 and the intermittent feeding of the papers P play a role of primary movement and a role of secondary movement in the printing process, respectively, thereby performing an ink-jet printing operation.

The printing device 940 comprises, in addition to the head unit 930, a carriage motor 941 for driving the head unit 930, and a reciprocator mechanism 942 for causing the head unit 930 to reciprocate in response to the rotation of the carriage motor 941. The head unit 930 comprises an ink-jet head 1 having the nozzle holes 21 (ink-ejecting apertures 211) at its bottom side; an ink cartridge 931 for supplying ink to the ink-jet head 1; and a carriage 932 which carries both of the ink-jet head 1 and the ink cartridge 931. The ink cartridge 931 contains ink of four colors, i.e., yellow, cyan, magenta and black, for the purpose of full color printing. The reciprocator mechanism 942 comprises a carriage guide shaft 944 whose opposite ends are supported on a frame (not shown), and a timing belt 943 extending in a parallel relationship with the guide shaft 944. The carriage 932 is reciprocatingly supported by the guide shaft 944 and also fixedly attached to a part of the timing belt 943.

When energizing the carriage motor 941, the timing belt 943 is caused to run in a forward or reverse direction by rotation of a pulley, whereby the head unit 930 reciprocates along the guide shaft 944. In the process of the reciprocating movement, the ink-jet head 1 ejects ink in an appropriate manner to perform printing on the paper P.

The sheet feeder 950 is provided with a feeding motor 951 for driving the sheet feeder 950 and feeding rollers 952 rotated in response to the operation of the feeding motor 951. The feeding rollers 952 comprises a driven roller 952*a* and a driving roller 952*b* which is operatively connected to the feeding motor 951. Both of the rollers 952*a* and 952*b* are disposed one on top the other in a mutually confronting relationship with a nip to feed the papers P left between the rollers 952*a* and 952*b*. This arrangement assures that the feeding rollers 952 can feed, in a sheet-by-sheet manner, the papers P held on the tray 921 toward the ink-jet head 1. In place of the tray 921, it would be possible to detachably mount a sheet-feeding cassette for storage of the papers P.

In response to the instruction received from a host computer (e.g., a personal computer, a digital camera and the like), the control unit 960 controls the printing device 940, the sheet feeder 950 and other devices to perform the printing operation.

Although not shown in the drawings, the control unit 960 generally comprises a memory for storing control programs for controlling each section of the printer; a drive circuit for applying pulse voltages to each electrode 81 of the ink-jet head 1 to control the ink ejecting timing; a drive circuit for driving the printing device 940 (carriage motor 941); a drive circuit for driving the sheet feeder 950 (feeding motor 951); a communication circuit for receiving printing data from the host computer; and a CPU connected to these components for performing various control operations. In addition, the CPU is further connected to a variety of sensors such as a sensor for detecting the residual quantity of ink in the ink cartridge 931; a sensor for detecting the position of the head unit 930.

When the printing data is received via a communication circuit from the host computer, the memory stores the received printing data in response to the instruction from the control unit 960. The CPU processes the stored printing data, and then each of the drive circuits generates drive signals based on the processed printing data and other data received from the sensors. In response to the drive signals from the drive circuits, an electrostatic actuator, the printing device 940 and the sheet feeder 950 performs their own operations, so that the printing can be done on the papers P.

Although the coating method, the liquid supplying head and the liquid supplying apparatus according to the present invention have been described in the foregoing in respect of the illustrated embodiment, it should be noted that the invention is not limited to the particular embodiment disclosed herein.

Taking an example, the coat that can be formed by the coating method of the present invention is not limited to the liquid-repellent coat, and may comprise other kinds of coats. If needed, the coating method of the present invention may include additional steps for other purposes.

Further, the liquid supplying head of the present invention may be applied to different kinds of heads that has a flow passageway (through-hole) as in a variety of dispensing nozzles, for instance.

Finally, it is to be understood that many changes and additions may be made to the embodiments described above without departing from the scope and spirit of the invention as defined in the appended Claims.

What is claimed is:

1. A coating method for forming a coat on a base material having at least one through-hole, the through-hole having an inner surface between one end and the other end thereof, the coat being formed on a predetermined partial region of the inner surface of the through-hole, the partial region of the inner surface running a predetermined length from the one end of the through-hole toward the other end, the method comprising the steps of:

forming a coat preform to be processed into the coat, on a region including the partial region of the inner surface of the through-hole;

closing up the one end of the through-hole by detachably attaching a sheet member onto the base material coated with the coat perform or by directly placing and fixing the base material coated with the coat perform onto a support stage which supports the base material during the formation of the coat;

supplying a mask material having ultraviolet ray absorbability into the through-hole having the coat preform;

irradiating ultraviolet rays onto the base material from a side at which the other end of the through-hole lies, to remove the coat preform irradiated by the ultraviolet rays while leaving intact the coat preform on the partial region, wherein the coat preform left through the irradiation forms the coat, and wherein the coat preform removal is conducted through the use of attenuation of the ultraviolet rays by means of the mask material or through the combined use of the ultraviolet ray attenuation and at least one of the presence and absence of the mask material; and removing the mask material in the through-hole and the sheet member or the support stage from the base material after the irradiation.

2. The coating method as claimed in claim 1, wherein the coat preform is formed from a liquid which contains a constituent of the coat.

3. The coating method as claimed in claim 1, wherein the ultraviolet rays are irradiated under an atmospheric pressure.

4. The coating method as claimed in claim 1, wherein the ultraviolet rays are irradiated in a nitrogen gas atmosphere.

5. The coating method as claimed in claim 1, wherein the ultraviolet rays are irradiated by irradiating means for emitting the ultraviolet rays, the irradiation being made under a condition that the base material is spaced apart 1-50 mm from the irradiating means.

6. The coating method as claimed in claim 1, wherein the wavelength of the ultraviolet rays is no greater than 250 nm.

7. The coating method as claimed in claim 1, wherein the illuminance of the ultraviolet rays is in the range of 1-50 $W/cm^2$.

8. The coating method as claimed in claim 1, wherein the mask material comprises a substance that shows no substantial change in quality under condition of applying the ultraviolet rays.

9. The coating method as claimed in claim 1, wherein the mask material comprises a substance that can be removed by volatilization.

10. The coating method as claimed in claim 1, wherein the mask material comprises a substance that can be removed by cleansing with water-based wash fluid.

11. The coating method as claimed in claim 1, wherein the mask material includes water as a main component.

12. The coating method as claimed in claim 1, wherein the mask material includes water-soluble polymer as a main component.

13. The coating method as claimed in claim 1, wherein the through-hole is provided at the one end thereof with an aperture whose average area is in the range of 75-750,000 $\mu m^2$.

14. The coating method as claimed in claim 1, wherein, at the step of forming the coat preform, the coat preform is formed on an external surface of the base material as well as on the inner surface of the through-hole, and wherein the coat is so formed as to extend continuously on the partial region of the inner surface of the through-hole, and further on the external surface of the base material lying at the same side as the one end of the through-hole.

* * * * *